United States Patent [19]

Siga et al.

[11] 4,414,024

[45] Nov. 8, 1983

[54] MARTENSITIC HEAT-RESISTANT STEEL

[75] Inventors: Masao Siga; Seishin Kirihara, both of Hitachi; Mitsuo Kuriyama, Tokai; Takatoshi Yosioka, Hitachi; Shintaro Takahashi, Hitachi; Takehiko Yoshida, Hitachi, all of Japan

[73] Assignee: Hitachi, Ltd., Tokyo, Japan

[21] Appl. No.: 411,802

[22] Filed: Aug. 26, 1982

[30] Foreign Application Priority Data

Aug. 26, 1981 [JP] Japan ..... 56-132798

[51] Int. Cl.[3] ..... C22C 38/22

[52] U.S. Cl. ..... 75/126 C; 75/126 E; 75/126 F; 75/126 J; 148/37

[58] Field of Search ..... 75/126 C, 126 E, 126 F, 75/126 J; 148/37

[56] References Cited

FOREIGN PATENT DOCUMENTS 55-110758 8/1980 Japan ..... 75/126 C 55-134159 10/1980 Japan ..... 75/126 C 56-6096056 8/1981 Japan ..... 75/126 C

*Primary Examiner*—L. Dewayne Rutledge

*Assistant Examiner*—Debbie Yee

*Attorney, Agent, or Firm*—Antonelli, Terry & Wands

[57] ABSTRACT

This invention discloses martensitic heat-resistant steel consisting essentially of 0.1 to 0.2 wt. % of C, up to 0.4 wt. % of Si, up to 1 wt. % of Mn, 9 to 12 wt. % of Cr, 0.1 to 0.3 wt. % of V, 0.02 to 0.25 wt. % of Nb, 0.03 to 0.1 wt. % of N, up to 1 wt. % of Ni, molybdenum and tungsten in amounts falling within the range encompassed by lines connecting a point A (0.7 wt. % of Mo and 1.1 wt. % of W), a point B (1.2 wt. % of Mo and 1.1 wt. % of W), a point C (1.6 wt. % of Mo and 0.33 wt. % of W) and a point D (0.7 wt. % of Mo and 0.33 and wt. % of W) as shown in FIG. 1 and the balance of iron.

The martensitic heat-resistant steel in accordance with the present invention is suitable for use in steam turbine blades and rotor shafts.

6 Claims, 6 Drawing Figures

MARTENSITIC HEAT-RESISTANT STEEL

BACKGROUND OF THE INVENTION (1) Field of the Invention

The present invention relates to martensitic heat-resistant steel, in particular to a martensitic heat-resistant steel having an increased high temperature strength which is suitably used for turbine blades and the like.

(2) Description of the Prior Art

In existing steam turbines which operate at steam temperatures of up to 566° C. and steam pressures of up to 246 atg, crucible steel 422 (12Cr-1Mo-1W-1/4V steel) or steel H46 (12Cr-Mo-Nb-V steel) is used for the blades and 1Cr-1Mo-1/4V steel or 11Cr-1Mo-V-Nb-N steel is used for the rotor shafts.

Recently, as the cost of fossil fuels such as petroleum and coal have been rising, it is important to improve the generator efficiency of thermoelectric power plants using such fossil fuels. It is necessary to raise the steam temperature or pressure of a steam turbine in order to increase the generator efficiency. Materials used for steam turbines have insufficient creep rupture strength and so stronger materials are needed.

Various kinds of materials having an increased high temperature strength have been proposed (for example, U.S. Pat. No. 3,139,337) and have been considerably effective. But these materials have insufficient creep rupture strength at temperatures higher than 550° C.

In view of creep rupture strength, Ni-base alloys and Co-base alloys are superior but these materials are expensive in addition to having inferior workability and a low damping constant.

SUMMARY OF THE INVENTION

It is an object of the present invention to eliminate the above described defects of the prior art to provide a martensitic heat-resistant steel having increased strength, in particular an increased creep rupture strength, at temperatures of 550° to 600° C.

DESCRIPTION OF THE PREFERRED EMBODIMENTS

The inventors of the present invention found from successive investigations that the addition of Mo and W to heat-resistant steel of 11Cr type containing C, Nb, Ni and N in amounts such that δ-ferrite may not be deposited leads to a rise of the creep strength.

Figure 1:
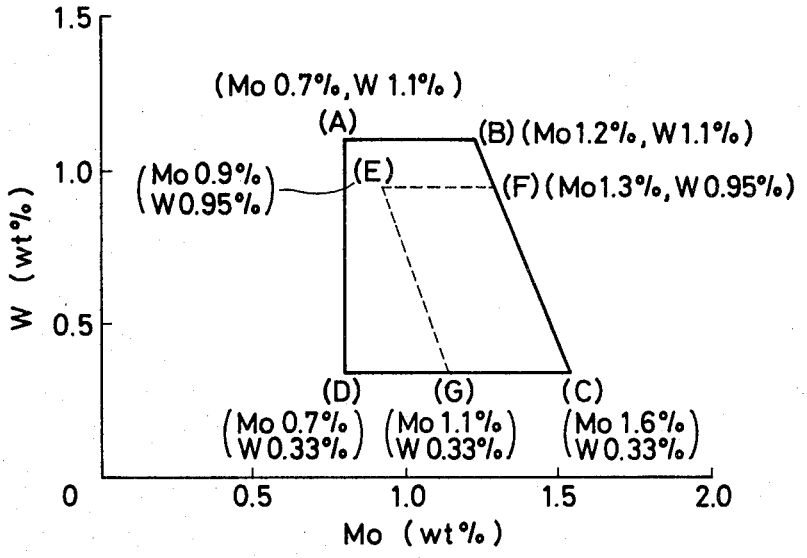
FIG. 1 is a diagram showing the range of the Mo and W content of steels according to the present invention.

The present invention relates to a martensitic heat-resistant steel having an increased high temperature strength, which was invented on the basis of the above discovery. The steel consists essentially of 9 to 12 wt.% Cr, 0.1 to 0.3 wt.% V, 0.02 to 0.25 wt.% Nb, 0.1 to 0.2 wt.% C, 0.03 to 0.1 wt.% N, Mo and W being contained within the range surrounded by the points A: (Mo 0.7 wt.%, W 1.1 wt.%), B: (1.2 wt.%, W 1.1 wt.%), C: (Mo 1.6 wt.%, W 0.33 wt.%) and D: (Mo 0.7 wt.%, W 0.33 wt.%), as shown in FIG. 1, 0.4 wt.% or less Si, 1 wt.% or less Mn, 1 wt.% or less Ni, and the remainder of Fe.

According to the present invention, although C is the essential element for achieving the desired tensile strength, too much of it leads to an unstable structure at higher temperatures and a decreased creep rupture strength. Thus the optimal C content of 0.1 to 0.2 wt.% was determined.

Although Nb is remarkably effective for increasing the high temperature strength, the addition of excessive amounts leads to the excessive deposition of niobium carbide and reduces the carbon concentration to reduce the strength, on the contrary. 0.07 to 0.25 wt.% Nb is preferably added since the quenching speed is fast for small-sized parts such as turbine blades in the case of the addition of Mo, W, V, and N to 11Cr type steels. On the other hand, for large-sized parts such as rotor shafts, a higher creep rupture strength can be achieved with a Nb content of 0.02 to 0.12 wt.% since the quenching speed is lower.

It was found that the addition of 0.1 wt.% more N leads to a remarkable decrease of toughness, although 0.03 wt.% or more N is effective for improving the creep rupture strength and preventing of δ-ferrite from developing. An especially preferred range is from 0.04 to 0.08 wt.%.

Cr is preferably added in amounts of 9 to 12 wt.% since the addition of 9 wt.% or less of Cr leads to insufficient corrosion resistance to high temperature and pressure steam while the addition of excessive amounts of Cr leads to the development of δ-ferrite although it improves the high temperature strength. An especially preferred range is from 10.5 to 11.5 wt.%.

Ni is preferably added in amounts of 1 wt.% or less because the addition of excessive amounts of Ni leads to a decrease of the creep rupture strength although it is remarkably effective for increasing the toughness and preventing δ-ferrite from developing. Especially preferred is a range of from 0.4 to 0.8 wt.%.

Mn, which is added as a deoxidizing agent in small amounts to achieve sufficient effects, is preferably added in amounts of 1 wt.% or less because addition in large amounts leads to the decrease of the high temperature strength. Especially preferred is a range of from 0.4 to 0.8 wt.%.

When of using steel manufacturing techniques such as the carbon vacuum deoxidizing method or the like, Si deoxidizing, in which Si is used as a deoxidizing agent, is not required. Si is preferably added in amounts of 0.4% or less by weight since a low Si content helps prevent δ-ferrite from depositing and prevent of temper brittleness. Especially preferred is a range of from 0.05 to 0.3 wt.%.

As for 11Cr type steels having compositions within the above described ranges, a lower Mo and W content decreases the creep rupture strength while a higher Mo and W content leads to the deposition of δ-ferrite and a decrease in the creep rupture strength. It was confirmed from experimental data that the appropriate amounts of Mo and W to be added is in the range defined by points A, B, C, D as shown in FIG. 1. In particular, the range defined by points E (Mo 0.9 wt.%, W 0.9 wt.%), F (Mo 1.3 wt.%, W 0.9 wt.%), C, G (Mo 1.1 wt.%, W 0.33 wt.%) is preferably selected since a still higher creep rupture strength can be achieved.

δ-ferrite lowers the ductility of steel, and the contents of the δ-ferrite forming elements are adjusted less δ-ferrite is substantially formed in the steel. The following chromium equivalent method is employed to prevent the formation of δ-ferrite. By this method each alloying constituent is given a numerical value as an austenite promoter or ferrite promoter, it having been found that when the numerical value of each alloying constituent is multiplied by the weight percent of the constituent present and algebraically added and the sum is less then ten, the structure obtained is essentially free from ferrite. The values of each of the chromium equivalents as austenite promoters and ferrite promoters are set forth in the table below, and it will be understood that any reference to chromium equivalents herein refers to the chromium equivalent calculated using the values in the table.

| Chromium Equivalents | |
|---|---|
| Austenite promoters: | |
| C | −40 |
| Mn | −2 |
| Ni | −4 |
| N | −30 |
| Ferrite promoters: | |
| Si | +6 |
| Cr | +1 |
| Mo | +4 |
| W | +1.5 |
| V | +11 |
| Nb | +5 |

The chromium equivalents for preventing the formation of δ-ferrite are somewhat affected by the quenching speed of the alloy steel. The chromium equivalents may be up to 10 in the case of small component parts because a high quenching speed can be used but in the case of large-scaled structures such as a steam turbine rotor shaft, the chromium equivalents are preferably below 9 because the quenching speed becomes low.

The alloy structure preferably has a fully tempered martensitic structure because strength as well as ductility are high.

Figure 2:
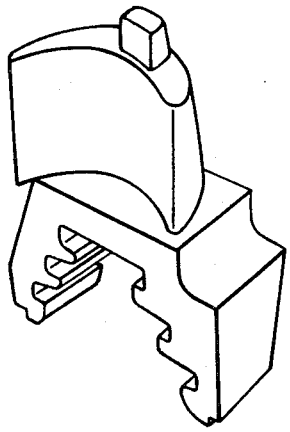
FIG. 2 is a perspective view showing an example of steam turbine blades.
Figure 3:
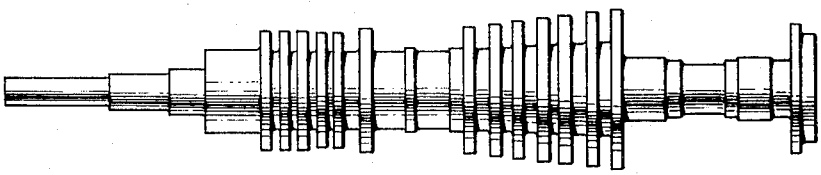
FIG. 3 is a schematic view showing an example of a steam turbine rotor shaft.

The martensitic heat-resistant steel in accordance with the present invention is suitable for use in steam turbine blades and a steam turbine rotor shaft shown in FIGS. 2 and 3 as the typical examples of steel application. The combination of alloying elements in the following composition is especially preferred.

STEAM TURBINE BLADES

The steel is preferably composed of forged steel consisting essentially of 0.1 to 0.2 wt.% of C, up to 0.4 wt.% of Si, up to 1 wt.% of Mn, 9 to 12 wt.% of Cr, 0.1 to 0.3 wt.% of V, 0.07 to 0.25 wt.% of Nb, 0.03 to 0.1 wt.% of N, up to 1 wt.% of Ni, Mo and W in amounts falling within the range encompassed by lines connecting a point A (0.7 wt.% of Mo and 1.1 wt.% of W), a point B (1.2 wt.% of Mo and 1.1 wt.% of W), a point C (1.6 wt.% of Mo and 0.33 wt.% of W) and a point D (0.7 wt.% of Mo and 0.33 wt.% of W) and the balance of Fe, having the chromium equivalents of up to 10 and consisting of a fully tempered martensitic structure.

Especially, the Mo and W contents are preferably within the range encompassed by lines connecting a point E (0.9 wt.% of Mo and 0.95 wt.% of W), a point F (1.3 wt.% of Mo and 0.95 wt.% of W), the point C (1.6 wt.% of Mo and 0.33 wt.% of W) and a point G (1.1 wt.% of Mo and 0.33 wt.% of W).

The fully tempered martensitic structure can be obtained by subjecting the steam turbine blades to the quenching treatment in which they are heated to 1,000° to 1,150° C. for 30 minutes to one hour and are then quenched to form the fully martensitic structure, and then to the tempering treatment in which they are heated to 600° to 700° C. for 1 to 5 hours and are then cooled slowly. Quenching is preferably carried out in oil and cooling after tempering is preferably furnace cooling.

STEAM TURBINE ROTOR SHAFT

The steel is preferably composed of forged steel consisting essentially of 0.1 to 0.2 wt.% of C, up to 0.4 wt.% of Si, up to 1 wt.% of Mn, 9 to 12 wt.% of Cr, 0.1 to 0.3 wt.% of V, 0.02 to 0.12 wt.% of Nb, 0.03 to 0.1 wt.% of N, up to 1 wt.% of Ni, Mo and W in amounts falling within the range encompassed by lines connecting a point A (0.7 wt.% of Mo and 1.1 wt.% of W), a point B (1.2 wt.% of Mo and 1.1 wt.% of W), a point C (1.6 wt.% of Mo and 0.33 wt.% of W) and a point D (0.7 wt.% of Mo and 0.33 wt.% of W) and the balance of Fe, having the chromium equivalents of up to 9 and consisting of a fully tempered martensitic structure. The Mo and W contents are preferably within the range encompassed by lines connecting a point E (0.9 wt.% of Mo and 0.95 wt.% of W), a point F (1.3 wt.% of Mo and 0.95 wt.% of W), the point C (1.6 wt.% of Mo and 0.33 wt.% of W) and a point G (1.1 wt.% of Mo and 0.33 wt.% of W).

The fully tempered martensitic structure can be obtained by subjecting the steam turbine rotor shaft to the quenching treatment in which it is heated uniformly to 1,050° to 1,100° C. and is then quenched to form the fully martensitic structure, then to the primary tempering treatment in which the rotor shaft is heated to 530° to 600° C. for 12 to 48 hours and is then quenched, and further to the secondary tempering treatment in which the rotor shaft is heated to a temperature, which is higher than the primary tempering temperature and is within the range of from 590° to 700° C., for at least 12 hours and then cooled slowly. The rotor shaft is preferably turned while being heated in both quenching and tempering. Cooling for quenching is preferably effected by spraying water while rotating the rotor shaft.

The martensitic heat-resistant steel in accordance with the present invention may contain up to 0.025 wt.% of P, up to 0.025 wt.% of S, up to 0.25 wt.% of Co, up to 0.05 wt.% of Al, up to 0.05 wt.% of Ti and up to 0.04 wt.% of Sn.

EXAMPLE 1

Slabs of 200 $\phi \times 800$ l were produced by means of a vacuum arc furnace and then forged to $35 \times 115 \times l$. Table 1 shows the chemical compositions of these typical forged samples. Sample No. 1 is equivalent to Crucible steel 422, sample No. 2 is equivalent to steel H46, and sample No. 3 is equivalent to the conventional 12 Cr type steels for rotors. All of these samples that is, sample Nos. 1, 2 and 3, as well as sample Nos. 4, 6, 8, 9, 12 and 13 were prepared for comparison with the materials according to the present invention, designated by Nos. 5, 7, 10, 11, and 14.

Sample No. 1 was quenched in oil after being uniformly heated at 1,050° C. and then tempered in the furnace at 630° C. for 3 hours. The samples other than No. 1 were quenched in oil after being uniformly heated at 1,100° C. and then tempered in the furnace at 650° C. for 3 hours.

Table 1 shows the measurement results of the above samples on tensile strength, elongation and reduction of area.

TABLE 1

| Sample No. | Ingredient (%) C | Si | Mn | Ni | Cr | Mo | V | Nb | W | N | Chomium equivalent | Tensile strength (kg/mm²) | Elongation (%) | Reduction of area (%) |
|---|---|---|---|---|---|---|---|---|---|---|---|---|---|---|
| 1 | 0.25 | 0.40 | 0.71 | 0.70 | 12.1 | 1.02 | 0.25 | — | 0.94 | 0.022 | 7.9 | 102.0 | 15.4 | 43.0 |
| 2 | 0.15 | 0.45 | 0.62 | 0.58 | 10.9 | 1.05 | 0.23 | 0.45 | — | 0.044 | 11.7 | 104.1 | 19.8 | 59.9 |
| 3 | 0.18 | 0.29 | 0.50 | 0.85 | 11.4 | 0.92 | 0.20 | 0.09 | — | 0.065 | 5.9 | 104.3 | 19.8 | 59.9 |
| 4 | 0.16 | 0.20 | 0.59 | 0.60 | 11.2 | 1.26 | 0.20 | 0.09 | 0.20 | 0.060 | 8.6 | 101.1 | 20.3 | 60.7 |
| 5 | 0.17 | 0.15 | 0.60 | 0.59 | 10.9 | 1.26 | 0.19 | 0.10 | 0.41 | 0.052 | 8.1 | 102.2 | 20.1 | 60.5 |
| 6 | 0.14 | 0.07 | 0.61 | 0.58 | 11.2 | 1.58 | 0.21 | 0.11 | 0.50 | 0.045 | 11.1 | 103.7 | 19.7 | 59.8 |
| 7 | 0.16 | 0.04 | 0.59 | 0.61 | 11.0 | 1.16 | 0.21 | 0.10 | 0.76 | 0.047 | 8.4 | 104.1 | 19.1 | 58.0 |
| 8 | 0.18 | 0.03 | 0.60 | 0.62 | 10.8 | 0.70 | 0.22 | 0.12 | 1.02 | 0.070 | 5.4 | 104.7 | 18.8 | 57.3 |
| 9 | 0.18 | 0.11 | 0.57 | 0.59 | 11.0 | 0.70 | 0.18 | 0.09 | 0.31 | 0.040 | 5.5 | 102.1 | 20.0 | 60.4 |
| 10 | 0.17 | 0.17 | 0.61 | 0.62 | 10.9 | 0.85 | 0.20 | 0.09 | 0.61 | 0.038 | 7.2 | 104.2 | 19.6 | 59.0 |
| 11 | 0.17 | 0.12 | 0.59 | 0.60 | 11.1 | 0.91 | 0.19 | 0.10 | 1.05 | 0.041 | 8.0 | 105.1 | 18.5 | 54.3 |
| 12 | 0.16 | 0.07 | 0.58 | 0.60 | 11.1 | 1.21 | 0.21 | 0.11 | 1.19 | 0.039 | 9.9 | 106.1 | 17.7 | 51.2 |
| 13 | 0.15 | 0.18 | 0.61 | 0.58 | 11.2 | 1.61 | 0.18 | 0.10 | 0.81 | 0.042 | 11.6 | 105.2 | 18.9 | 56.0 |
| 14 | 0.18 | 0.10 | 0.56 | 0.55 | 10.8 | 1.39 | 0.19 | 0.05 | 0.60 | 0.040 | 8.5 | 104.3 | 18.5 | 55.4 |

Figure 4:
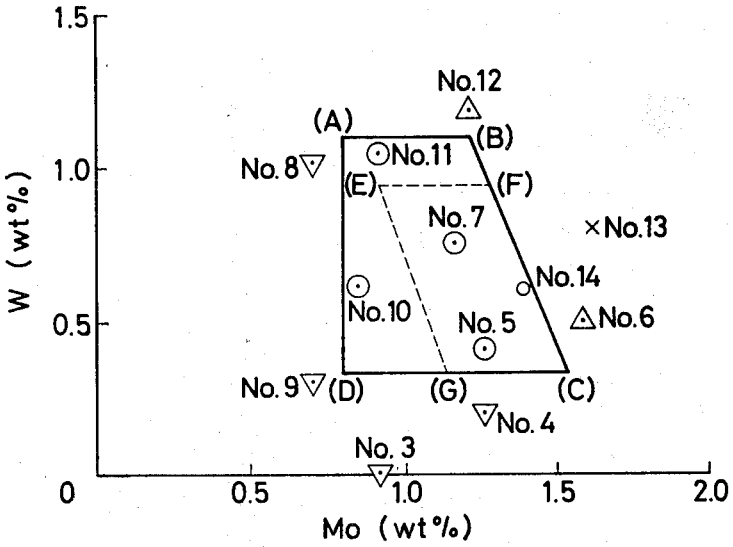
FIG. 4 is a diagram showing the results of strength and structure tests on steels according to the present invention.

FIG. 4 shows the relationship between the contents of Mo and W and to creep rupture strength at 600° C. as well as the deposition of δ-ferrite for 11Cr-Mo-W-0.2V-0.1Nb-0.05N steel. It is clearly found from FIG. 4 that the addition of excess Mo and W leads to the deposition of δ-ferrite and a reduction of the creep rupture strength, and after all the contents of Mo and W, which lead to higher creep rupture strength and the development of a homogeneous martensitic structure, are within the range defined by the points A, B, C and D, and preferably within the range defined by the points E, F, C and G to achieve a still higher creep rupture strength.

It was defined that the materials showing a creep rupture strength $\sigma_R$ measured after creeping for $10^5$ hours at 600° C. of 15 kg/mm² or more pass the test and those showing a creep rupture strength less than 15 kg/mm² fail the test. In addition, it was defined that the materials showing no δ-ferrite structure pass the test and those showing δ-ferritic structure fail the test. Mark O designates both the creep rupture strength and the structure pass the tests; mark Δ designates the creep rupture strength passes the test but the structure fails the test; mark ∇ designates that the creep rupture strength fails the test but the structure passes the test; and mark X designates that both of the creep rupture strength and the structure fail the tests.

Furthermore, it was found that a Si content of 0.4 wt.% or more leads to the deposition of δ-ferrite even if the Mo and W content is within the range surrounded by the points A, B, C, D. It was also found that the samples containing δ-ferrite show a reduced fatigue strength.

It was also found that 11Cr-1.3Mo-0.2W-0.2V-0.05N-Nb steel shows an increased creep rupture strength at a Nb content of 0.07 to 0.25 wt.%. Steels of this type showed a slightly reduced creep rupture strength at a Nb content of 0.05 wt.%.

Figure 5:
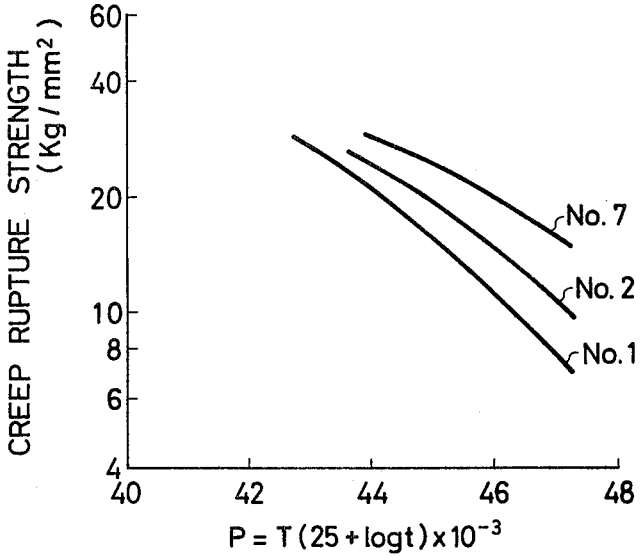
FIG. 5 is a graph showing the results of creep rupture tests by means of Ralson-Miller's method for steels according to the present invention.

FIG. 5 shows the results of creep rupture tests by means of Ralson-Miller's parameter method for crucible steel 422 (No. 1) as well as steel H46 (No. 2), which are being used at present as material for turbines, and steel No. 7 according to the present invention. Ralson-Miller's parameter P calculated by the following equation is plotted on the abscissa and the stresses are plotted on the ordinate:

$$P = T(25 + \log t) \times 10^{-3}$$

wherein T is temperature (°R = °F. + 460); and t is time (hours). It can be seen from FIG. 5 that the materials according to the present invention show a remarkably higher creep rupture strength than the conventional materials after creeping for $10^5$ hours at 600° C. of 15.7 kg/mm², and thereby are more suitable for use in high-efficiency steam turbine blades operating at temperatures up to 600° C.

In general, it is well known that parts become brittle after operation at high temperatures for a long time and thereby their service life (Impact strength) is reduced. It was found from the results of impact strength tests after heating for 3,000 hours at 550° C. that the materials according to the present invention have remarkably low tendency of becoming brittle in comparison with the conventional materials (No. 3).

EXAMPLE 2

Sample No. 14 in Table 1 was subjected to heat treatment equivalent to that to which the central holes of the large-sized steam turbine for rotor shaft are subjected. The conditions are as follows:

Quenching: at 1,050° C. and cooled at a rate of 100° C./hour

Tempering: 570° C. × 15 hours AC; 665° C. × 30 hours F.C

Figure 6:
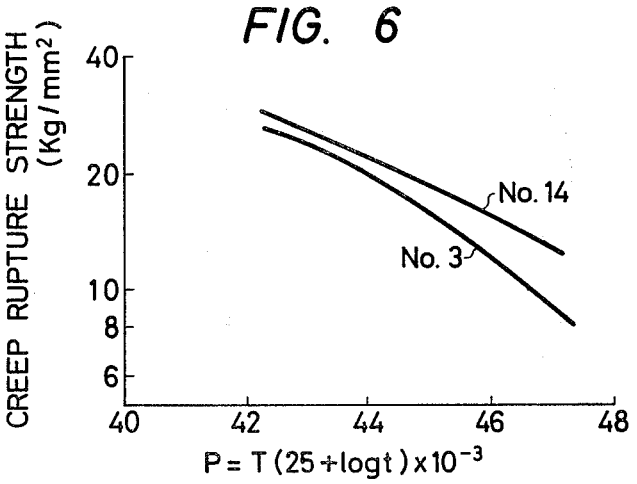
FIG. 6 is a graph showing the results of creep rupture tests by means of Ralson-Miller's method for steels of the comparative examples.

FIG. 6 shows the results of creep rupture tests by means of Ralson-Miller's parameter method for this sample. The results of creep rupture tests for the conventional material (the sample No. 3) are also shown for comparison. It can be seen from FIG. 4 that the material according to the present invention (No. 14) shows a remarkably higher creep rupture strength than the conventional material (no. 3). Furthermore, it was confirmed that materials containing amounts of Mo and W within the range defined by points A, B, C and D, preferably points E, F, C and D as shown in FIG. 1 show an increased creep rupture strength (11 kg/mm² or more for $10^5$ hours at 600° C.), and the homogeneous martensitic structure required for high efficiency steam turbine rotors operating at steam temperatures up to 600° C.

In addition, it was found from the measured results of creep rupture strength tests for 11Cr-1.3Mo-0.3W-

0.2V-0.05N-Nb steel containing Nb in different quantities that the addition of Nb in amounts of 0.05 to 0.10 wt.% leads to an increased creep rupture strength. The addition of Nb in amounts of 0.21 wt.% led to slightly reduced creep rupture strength.

It is important for the materials of rotor shafts to have higher creep rupture strength, tensile strength and impact strength. It was confirmed from the results of tests of the material (No. 14) according to the present invention that it shows superior mechanical properties required of materials for steam turbine rotor shafts, for example, the creep rupture strength after creeping for $10^5$ hours at 600° C. was 12.5 kg/mm$^2$, tensile strength of 93.0 kg/mm$^2$ and Sharpy's V-notched impact value of 1.5 kg-m, and has the homogeneous tempered martensitic structure not containing δ-ferritic structure.

As described above in detail, martensitic heat-resistant steels according to the present invention have a remarkably higher high temperature strength, in particular a higher creep rupture strength, and are thereby preferably used as the material for high efficiency steam turbine blades and rotors operating at steam temperatures of up to 600° C.

What is claimed is:

1. A martensitic heat-resistant steel consisting essentially of 0.1 to 0.2 wt.% of carbon, up to 0.4 wt.% of silicon, up to 1 wt.% of manganese, 9 to 12 wt.% of chromium, 0.1 to 0.3 wt.% of vanadium, 0.02 to 0.25 wt.% of niobium, 0.03 to 0.1 wt.% of nitrogen, up to 1 wt.% of nickel, molybdenum and tungsten in amounts falling within the range encompassed by lines connecting a point A (0.7 wt.% of molybdenum and 1.1 wt.% of tungsten), a point B (1.2 wt.% of molybdenum and 1.1 wt.% of tungsten), a point C (1.6 wt.% of molybdenum and 0.33 wt.% of tungsten) and a point D (0.7 wt.% of molybdenum and 0.33 wt.% of tungsten), and the balance of iron; said steel having a fully tempered martensitic structure and a Cr equivalent of up to 10 and showing substantially no δ ferritic structure and when said steel is subjected to tempering after quenching, the creep rupture strength for $10^5$ hours at 600° C. is 11 kg/mm$^2$ or more.

2. A martensitic heat-resistant steel consisting essentially of 0.1 to 0.2 wt.% of carbon, 0.05 to 0.3 wt.% of silicon, 0.4 to 0.8 wt.% of manganese, 10.5 to 11.5 wt.% of chromium, 0.1 to 0.3 wt.% of vanadium, 0.02 to 0.25 wt.% of niobium, 0.04 to 0.08 wt.% of nitrogen, 0.4 to 0.8 wt.% of nickel, molybdenum and tungsten in amounts falling within the range encompassed by lines connecting a point A (0.7 wt.% of molybdenum and 1.1 wt.% of tungsten), a point B (1.2 wt.% of molybdenum and 1.1 wt.% of tungsten), a point C (1.6 wt.% of molybdenum and 0.33 wt.% of tungsten) and a point D (0.7 wt.% of molybdenum and 0.33 wt.% of tungsten) and the balance of iron; said steel having a fully tempered martensitic structure and a Cr equivalent of up to 10 and showing substantially no δ ferritic structure and when said steel is subjected to tempering after quenching, the creep rupture strength for $10^5$ hours at 600° C. is 11 kg/mm$^2$ or more.

3. A steam turbine blade made of forged steel, said forged steel consisting essentially of 0.1 to 0.2 wt.% of carbon, up to 0.4 wt.% of silicon, up to 1 wt.% of manganese, 9 to 12 wt.% of chromium, 0.1 to 0.3 wt.% of vanadium, 0.07 to 0.25 wt.% of niobium, 0.03 to 0.1 wt.% of nitrogen, up to 1 wt.% of nickel, molybdenum and tungsten in amounts falling within the range encompassed by lines connecting a point A (0.7 wt.% of molybdenum and 1.1 wt.% of tungsten), a point B (1.2 wt.% of molybdenum and 1.1 wt.% of tungsten), a point C (1.6 wt.% of molybdenum and 0.33 wt.% of tungsten) and a point D (0.7 wt.% of molybdenum and 0.33 wt.% of tungsten) and the balance of iron, and said steel having a fully tempered martensitic structure and a Cr equivalent of up to 10 and showing substantially no δ ferritic structure, said steel having been subjected to tempering after quenching in oil, to exhibit a creep rupture strength for $10^5$ hours at 600° C. of 15 kg/mm$^2$ or more.

4. The steam turbine blades as defined in claim 3 wherein the amounts of molybdenum and tungsten are within the range encompassed by lines connecting a point E (0.9 wt.% of molybdenum and 0.95 wt.% of tungsten), a point F (1.3 wt.% of molybdenum and 0.95 wt.% of tungsten), said point C (1.6 wt.% of molybdenum and 0.33 wt.% of tungsten) and a point G (1.1 wt.% of molybdenum and 0.33 wt.% of tungsten).

5. A rotor shaft for steam turbines made of forged steel, said forged steel consisting essentially of 0.1 to 0.2 wt.% of carbon, up to 0.4 wt.% of silicon, up to 1 wt.% of manganese, 9 to 12 wt.% of chromium, 0.1 to 0.3 wt.% of vanadium, 0.02 to 0.12 wt.% of niobium, 0.03 to 0.1 wt.% of nitrogen, up to 1 wt.% of nickel, molybdenum and tungsten in amounts falling within the range encompassed by lines connecting a point A (0.7 wt.% of molybdenum and 1.1 wt.% of tungsten), a point B (1.2 wt.% of molybdenum and 1.1 wt.% of tungsten), a point C (1.6 wt.% of molybdenum and 0.33 wt.% of tungsten) and a point D (0.7 wt.% of molybdenum and 0.33 wt.% of tungsten) and the balance of iron, said steel having a fully tempered martensitic structure and a Cr equivalent of up to 9 and showing substantially no δ ferritic structure, and said steel having been subjected to tempering after quenching to exhibit a creep rupture strength for $10^5$ at 600° C. of 11 kg/mm$^2$.

6. The rotor shaft for steam turbines as defined in claim 5 wherein the amounts of molybdenum and tungsten are within the range encompassed by lines connecting a point E (0.9 wt.% of molybdenum and 0.95 wt.% of tungsten), a point F (1.3 wt.% of molybdenum and 0.95 wt.% of tungsten), said point C (1.6 wt.% of molybdenum and 0.33 wt.% of tungsten) and a point G (1.1 wt.% of molybdenum and 0.33 wt.% of tungsten).

* * * * *